US005115756A

United States Patent [19]

Maffei

[11] Patent Number: 5,115,756

[45] Date of Patent: May 26, 1992

[54] PENNANT/FLAG CONSTRUCTION

[76] Inventor: John J. Maffei, 41 Mimi Rd., Old Bridge, N.J. 08857

[21] Appl. No.: 712,370

[22] Filed: Jun. 10, 1991

[51] Int. Cl.[5] ..... G08B 7/02; G09F 27/00

[52] U.S. Cl. ..... 116/2; 116/174; 446/265; 446/420

[58] Field of Search ..... 116/2, 4, 173, 174, 116/280, 306, 307, 137 R; 446/265, 420, 242, 266

[56] References Cited

U.S. PATENT DOCUMENTS

| | | | |
|---|---|---|---|
| 298,575 | 5/1884 | Goodfellow | 446/265 |
| 1,022,360 | 4/1912 | Fitzsimons | 116/174 |
| 1,338,210 | 4/1920 | Buckley | 116/173 |
| 1,631,566 | 6/1927 | Walton | 116/173 |
| 1,646,467 | 10/1927 | Walton | 116/174 |
| 1,764,982 | 6/1930 | Reich et al. | 446/265 |
| 2,090,121 | 8/1937 | Hayes | 116/173 |
| 3,138,249 | 6/1964 | Paulini | 116/173 |
| 3,183,886 | 5/1965 | Moffitt, Jr. | 116/173 |
| 3,969,837 | 7/1976 | Kresse | 40/126 R |
| 4,227,406 | 10/1980 | Coffey | 116/26 |
| 4,601,255 | 7/1986 | Marcotti | 116/173 |
| 4,603,652 | 8/1986 | Thibault et al. | 116/174 |
| 5,039,048 | 8/1991 | Paxton | 116/173 |

FOREIGN PATENT DOCUMENTS

| | | | |
|---|---|---|---|
| 0013948 | 6/1881 | Fed. Rep. of Germany | 446/420 |

*Primary Examiner*—Allan M. Shoap
*Assistant Examiner*—John L. Beres
*Attorney, Agent, or Firm*—Henderson & Sturm

[57] ABSTRACT

A pennant assembly (10) including a pennant unit (11) rotatably supported on a pole unit (12) by a support unit (13) and further including a noise making unit (14) operatively deployed between the support unit (13) and the pole unit (12) whereby noise will be generated as the support unit (13) rotates relative to the pole unit (12).

2 Claims, 1 Drawing Sheet

FIG. 1.
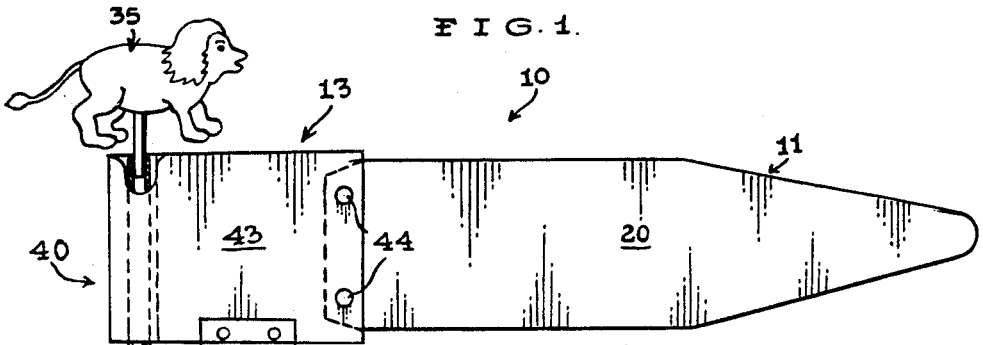
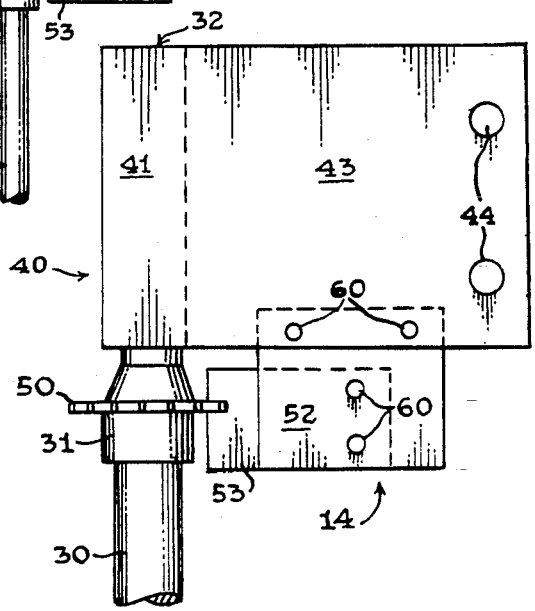
FIG. 2.
FIG. 3.
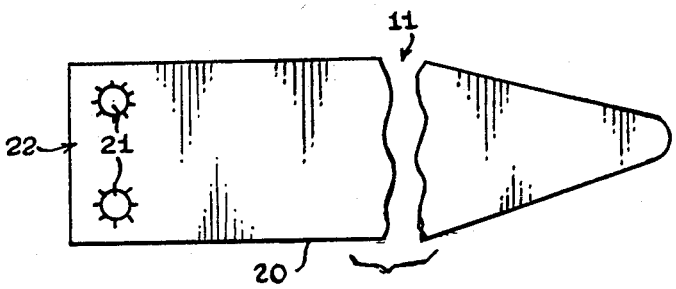
FIG. 4.
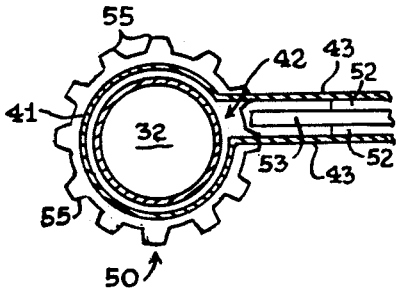

PENNANT/FLAG CONSTRUCTION

TECHNICAL FIELD

The present invention relates to the field of flagpole constructions in general, and in particular to an improved mounting arrangement for flags or pennants wherein the mounting arrangement creates a noise-making relationship between the pole and the flag or pennant.

BACKGROUND ART

This invention was the subject matter of Document Disclosure Program Registration No. 269,945 which was filed in the U.S. Patent and Trademark Office on Dec. 21, 1990.

As can be seen by reference to the following U.S. Pat. Nos. 2,090,121; 3,138,249; 3,969,837; and 4,601,255, the prior art is replete with myriad and diverse mounting arrangements between a pole and a decorative item suspended from the pole.

While all of the aforementioned prior art constructions are more than adequate for the basic purpose and function for which they have been specifically designed, these patented arrangements have been uniformly deficient with regard to the inclusion of a noise making element to the standard pole and pennant combination.

As anyone who has attended a team based sporting event is aware, one of the most prominent fan associated accessories evident at these events are pennants bearing the names and/or mascots of the respective teams.

As a consequence of the foregoing situation, there has existed a longstanding need among rabid sports fans for a new type of pennant construction with which to root for their favorite team, wherein the pennant flag is not only rotatable relative to the pennant shaft, but also produces noise during that rotation. The provision of such a construction is a stated objective of the present invention.

DISCLOSURE OF THE INVENTION

Briefly stated, the pennant assembly that forms the basis of the present invention comprises a pennant flag unit, a pennant flag support unit, a pennant pole unit, and a noise making unit operatively disposed between the pennant support unit and the pennant pole unit.

The two primary structural differences between the pennant assembly that forms the basis of the present invention and a conventional pennant assembly involves the fact that the pennant flag support unit is relatively rigid and rotatably disposed on the pennant pole unit, plus the fact that a noise making unit is incorporated into the present assembly.

As will be explained in greater detail further on in the specification, the noise unit comprises a sprocket member disposed on the pennant pole unit and a flexible vane member that is attached to the pennant support unit and adapted to audibly contact the spoke member as the pennant support unit revolves around the pennant pole unit.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 1 is a side plan view of the pennant assembly that forms the basis of the present invention;

FIG. 2 is an isolated view of the pennant pole unit pennant support unit and noise making unit;

FIG. 3 is a side plan view of the pennant flag unit; and

FIG. 4 is an isolated top plan view of the engagement between the sprocket and vane members of the noise making unit.

BEST MODE FOR CARRYING OUT THE INVENTION

As can be seen by reference to the drawings, and in particular to FIG. 1, the pennant assembly that forms the basis of the present invention is designated generally by the reference numeral (10). The assembly (10) comprises in general a pennant unit (11), a pole unit (12), a support unit (13) and a noise making unit (14). These units will now be described in seriatim fashion.

As shown in FIGS. 1 and 3, the pennant unit (11) comprises in general an elongated pennant member (20) provided with a plurality of mounting apertures (21) disposed proximate the inboard end (22) of the flag member (20).

Turning now to FIGS. 1, 2 and 4, it can be seen that the pole unit (12) comprises a generally cylindrical elongated pole member (30) having a collar bearing element (31) disposed proximate to, but spaced from the upper end of the pole member (30). The upper end of the pole member (30) is further provided with a central recess (32), whose purpose and function will be described in greater detail further on in the specification.

Still referring to FIGS. 1, 2 and 4, it can be seen that the support unit (13) comprises a bracket member (40) including an elongated generally cylindrical stem element (41) having an elongated relatively narrow peripheral slot (42) formed on one side of the bracket member (40). Both sides of the peripheral slot (42) are encompassed by a pair of outwardly extending generally parallel clamp arms (43) having enlarged apertures (44) formed proximate their outboard ends. The enlarged apertures (44) in the clamp arms (43) are dimensioned similar to the apertures (21) in the pennant whereby conventional securing means (not shown) can pass through the apertures (44, 21) to operatively engage the pennant member (20) to the bracket member (40) in a well recognized fashion.

Still referring to FIGS. 1, 2 and 4, it can be seen that the noise making unit (14) comprises a spoke collar member (50) peripherally disposed on the collar bearing element (31) of the pole member (30) and a pair of discrete clamp plates (52) sandwiched between the clamp arms (43) of the bracket member (40). The clamp plates (52) further engage a flexible card element (53) in a sandwich fashion between the clamp plates (52). The free end of the card element (53) will be flexibly deformed by the spoke elements (55) on the collar member (50) to produce noise in much the same manner as a playing card being interposed between the path of travel of the spokes on a bicycle wheel.

As can best be seen by reference to FIG. 2, conventional securing means (60) are employed to secure the clamp plates (52) to the bottom portion of the arms (43) of the bracket member (40), and to secure the card element (53) to the inboard end of the clamp plates (53) in a well recognized fashion.

As can best be seen by reference to FIGS. 1 and 2, the collar bearing element (31) on the pole member (30) is dimensioned to arrest the downward travel and rotatably support the bracket member (40) relative to the pole member (30). In addition, the central recess (32) in the upper end of the pole member (30) is dimensioned to receive an enlarged standard (35) such as a replica of a mascot or the like. The enlarged standard (35) will arrest the upward travel of the bracket member (40) relative to the pole member (30).

In this manner, as the bracket member (30) and pennant (20) are rotated about the upper portion of the pole member (30), the card element (53) will be brought into successive engagement with the spokes (55) of the spoke collar member (50) to add a noise making capability to the assembly (10).

Having thereby described the subject matter of the present invention, it should be apparent that many substitutions, modifications and variations of the present invention are possible in light of the above teachings. It is therefore to be understood that the invention as taught and described herein is only to be limited to the extent of the breadth and scope of the appended claims.

I claim:

1. A pennant assembly comprising:

a pole unit including a pole member having a collar bearing element disposed proximate to but spaced from the upper end of the pole member;

a support unit including a bracket member rotatably supported on said pole member at a point above the location of said collar bearing element;

a pennant unit including a pennant member operatively attached to said bracket member; wherein, the bracket member includes a generally cylindrical stem element rotatably disposed on said pole member; and, wherein the stem element is provided with a pair of clamp arms that are adapted to engage one end of the pennant member;

a noise making unit operatively associated with said pole unit and said support unit; wherein said noise making unit comprises; a spoke collar element provided with a plurality of spokes and disposed on said pole member; and a flexible card element operatively associated with the bracket member so as to be brought into sequential engagement with the spokes on said spoke collar element as the bracket member is rotated about the upper end of the pole member; and, at least one downwardly depending clamp plate secured to one of the clamp arms of the bracket member wherein the flexible card element is secured to said at least one clamp plate.

2. The assembly as in claim 1 wherein the upper end of the pole member is further provided with an enlarged standard that will arrest the upward travel of the bracket member relative to the pole member.

* * * * *